US005525759A

United States Patent [19]

Salzman

[11] Patent Number: 5,525,759

[45] Date of Patent: Jun. 11, 1996

[54] PIN-SHAPED FEEDTHROUGH

[76] Inventor: Phil M. Salzman, 2282 Fairglen Dr., San Jose, Calif. 95125

[21] Appl. No.: 229,985

[22] Filed: Apr. 19, 1994

[51] Int. Cl.[6] ..... H01B 17/26

[52] U.S. Cl. ..... 174/151; 174/50.55; 174/50.56; 174/50.57; 174/65 R

[58] Field of Search ..... 174/65 R, 76, 174/77 R, 50.55, 50.56, 50.57, 50.61, 50.62, 50.63, 267, 151; 439/936

[56] References Cited

U.S. PATENT DOCUMENTS

| | | | |
|---|---|---|---|
| 2,864,883 | 12/1958 | Townsend | 174/151 |
| 2,985,291 | 5/1961 | Schoepe et al. | 174/151 X |
| 3,171,990 | 3/1965 | Bennett | 174/151 X |
| 3,875,479 | 4/1975 | Jagger | 174/267 X |
| 3,975,579 | 8/1976 | Davis et al. | 174/153 R |
| 4,110,904 | 9/1978 | Johnson | 174/267 X |
| 4,251,680 | 2/1981 | Germann | 174/151 X |
| 4,262,913 | 4/1981 | Parfree et al. | 174/76 X |
| 4,309,568 | 1/1982 | Isaksson | 174/151 |
| 4,528,449 | 7/1985 | Gordon et al. . | |
| 4,645,931 | 2/1987 | Gordon et al. . | |
| 4,741,801 | 5/1988 | Coleman . | |
| 5,198,885 | 3/1993 | Ibrahim . | |
| 5,200,232 | 4/1993 | Tappan et al. . | |
| 5,227,587 | 7/1993 | Paterek | 174/151 X |
| 5,359,496 | 10/1994 | Kornrumpf et al. | 361/795 |

*Primary Examiner*—Kristine L. Kincaid
*Assistant Examiner*—Paramita Ghosh
*Attorney, Agent, or Firm*—Donald Verplancken; B. Todd Patterson

[57] ABSTRACT

A feedthrough extending through the wall of an enclosure includes a body portion having a stem portion extending through the wall and a head portion abutting against the wall. The feedthrough assembly further includes a seal member and a biasing member to bias at least a portion of the head against the seal member. The body portion may be conductive, to form an electric current path through the wall of the enclosure, or may form a non-conductive passage to route a feed member, such as an optic cable, or tubular gas or liquid supply conduits, into the enclosure.

33 Claims, 5 Drawing Sheets

PIN-SHAPED FEEDTHROUGH

BACKGROUND OF THE INVENTION

1. Field of the Invention

The present invention relates to electrical and other types of connections that penetrate through the walls of an enclosure, wherein the enclosure may be maintained at atmospheric, sub-atmospheric or super-atmospheric pressure and/or in a chemically or electrochemically active state. In particular, the invention relates to feedthroughs in which a longitudinal biasing force both holds the feedthrough member in the enclosure wall and elastically seals the connection of the feedthrough through the enclosure wall.

2. Background of the Prior Art

A feedthrough is used to pass a conductor, a conduit, or other member through an aperture in the wall of an enclosure such as a semiconductor processing chamber. The feedthrough must be capable of withstanding chemically or electrochemically corrosive and/or explosive environments which may be maintained within the enclosure, while simultaneously sealing the aperture to maintain the isolation of the enclosure from the environment and prevent leakage of any corrosive or explosive materials therethrough. Additionally, where the feedthrough is supplying an electric current into the enclosure, the conductive portion of the feedthrough must not touch the wall of the enclosure or aperture. The enclosure wall is typically maintained at ground potential, and, if the conductive portion of the feedthrough does touch the wall it will short to ground. Further, in some applications the enclosure wall may be maintained at a high voltage. In that instance, if the conductive portion of the feedthrough touches the wall of the enclosure or aperture, the internal componentry being fed by the feedthrough will receive an electrical overload.

In one known method of providing an electrical feedthrough, a conductor such as a wire is held through the enclosure aperture, and a molten glass or ceramic potting material is poured into the aperture around the conductor. When the molten material hardens, it forms a sealing mass around the conductor within the aperture. Glass or ceramic potting materials are used in many feedthrough applications because they have high electrical insulative properties and are relatively impervious to the processing environments maintained within the enclosure. As a result, they maintain their sealing integrity through thousands of processing cycles. However, the glass or ceramic-based feedthrough has several disadvantages. First, the conductor of the feedthrough, such as the aforementioned wire, must be maintained in a specific location within the aperture while the molten material is formed around the conductor. If the conductor alignment through the aperture is disturbed as the feedthrough seal is formed and the conductor contacts the side of the aperture, the feedthrough will short to ground in the case of a grounded enclosure, or feed a surge current into the enclosure where the enclosure wall is maintained at a high voltage. Further, the final dimensions of the glass and ceramic materials are difficult to control, and protrusions of these insulating materials may form around the aperture and prevent the placing of componentry directly adjacent to the entry of the aperture into the enclosure. Additionally, the conductor or conductors passing through the glass or ceramic body must be connected to a circuit after the feedthrough is created, most commonly by soldering. It has been found that in some applications, particularly where the internal component being fed by the feedthrough is a delicate member such as a printed circuit board, the soldering of the conductor to the internal apparatus may lead to failure of the internal component.

The processing of the glass or ceramic to form the body of the feedthrough also limits the types of connections which can be made with the feedthrough. The melting temperature of the glass and ceramic sealing materials limits their use to feedthroughs having metallic or other conductors with high melting temperatures. Also, if a glass or ceramic feedthrough fails, an equipment user must have the capability to melt glass or ceramic and pour it in place to recreate the feedthrough, or must remove the equipment to a shop where a new feedthrough can be fabricated in the aperture. Both options are expensive and time consuming. Finally, where the enclosure is heated or cooled, the differential rates of expansion between the enclosure material and the glass or ceramic material can lead to leakage or failure of the feedthrough.

One alternative to forming the feedthrough by pouring a molten glass or ceramic around a solid conductor is to first create a ceramic or glass body in the aperture, and then form the conductor through the body. However, to obtain desirable sealing characteristics the ceramic or glass body must be formed in the aperture from a molten glass or ceramic potting material, and the conductor must be formed from a molten conductive material poured through a secondary aperture in the body. The secondary aperture may be formed as the body is formed, or, the secondary aperture may be drilled through the solidified body. The need to melt and pour the conductive material and the glass or ceramic potting material makes these feedthroughs as difficult to form and replace as those formed by pouring the molten glass or ceramic around a solid conductor.

In some processing environments, epoxy or other adhesives may be used in place of glass or ceramic to form the body of the feedthrough. These materials overcome the problems associated with forming high temperature molten materials in the aperture to create the feedthrough. However, a conductor may still come into contact with the enclosure wall as this type of feedthrough is formed, and the epoxy or adhesive materials will also form material protrusions around the entry of the aperture into the enclosure and thus prevent the placement of componentry directly adjacent to the entry of the aperture into the enclosure.

SUMMARY OF THE INVENTION

The present invention is a feedthrough useful for passing a connection through an aperture in a chamber wall and isolating the connection from the wall, while also maintaining a seal between the chamber conditions and the ambient conditions outside of the chamber. The feedthrough includes a body member having an enlarged head portion which is supported from the wall of the chamber by a conformable, physically and electrically isolating seal member, a stem member which extends through the aperture to interconnect internal and external componentry, and a biasing member which biases the seal member into sealing engagement with both the head portion and chamber wall. The feedthrough is easily field replaceable with a minimum of chamber down time and may be retrofitted into apertures meant for use with other types of feedthroughs, such as glass, ceramic, epoxy or adhesive feedthroughs.

BRIEF DESCRIPTION OF THE DRAWINGS

These and other features and advantages of the invention will become apparent from the description of the embodiments, when read in conjunction with the following drawings, wherein.

DESCRIPTION OF THE EMBODIMENTS

Figure 1:
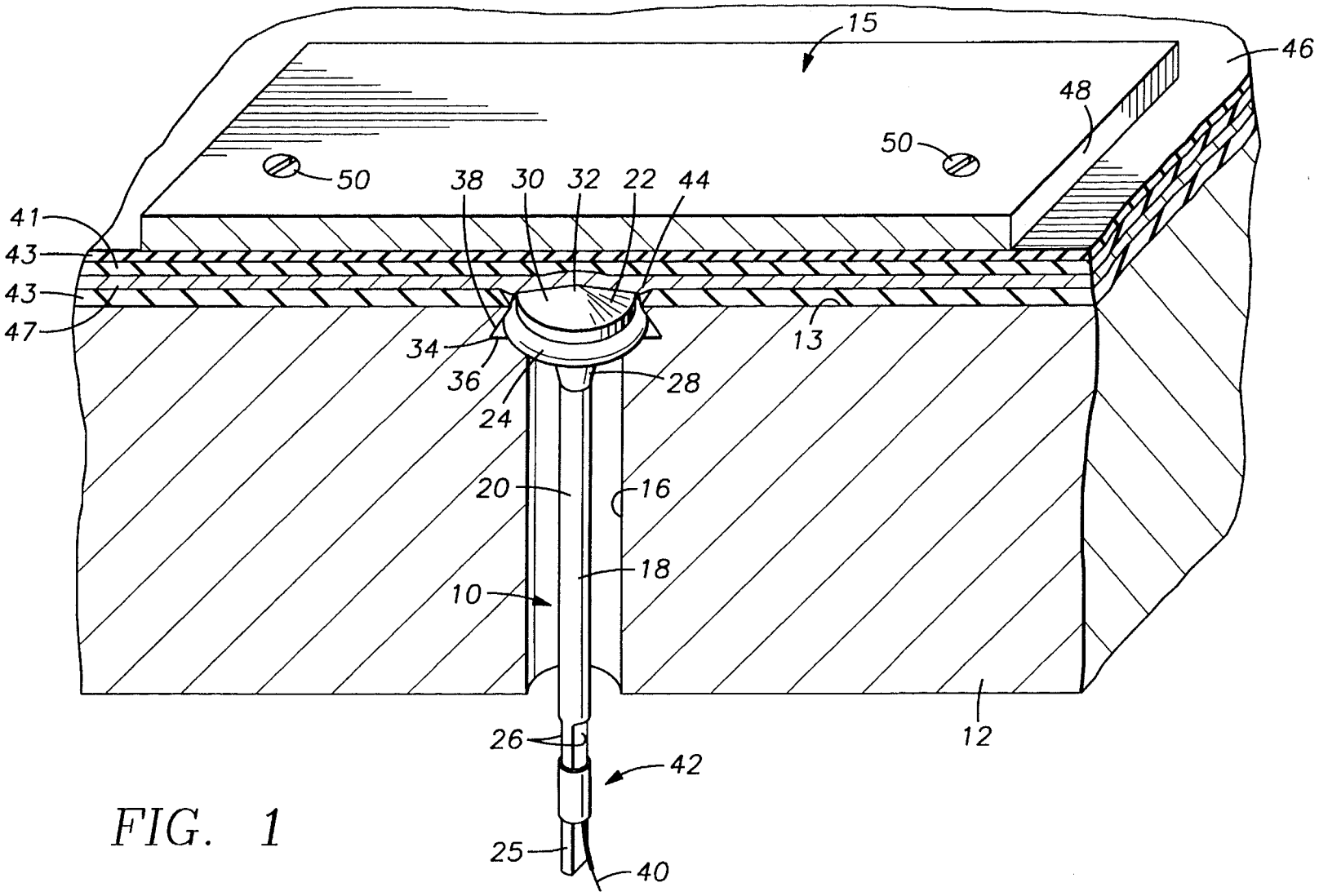
FIG. 1 is a perspective view, in section, of a portion of a wall of an enclosure showing the feedthrough of the present invention extending through an aperture in the wall of the enclosure.

Referring to FIG. 1, the feedthrough apparatus 10 of the present invention is shown extending through an aperture 16 in a wall 12 of an enclosure for providing inputs or outputs through the wall 12 without affecting the integrity of the isolation of the enclosure from the ambient conditions existing outside of the enclosure. The input or output may be, among other things, an electrical signal or electrical power supply, an optic cable, or a conduit for a gas or a liquid. In the embodiment shown in FIG. 1, the feedthrough 10 is an electrical feedthrough, and the enclosure is the interior of a semiconductor processing chamber. The enclosure may be maintained at atmospheric, super-atmospheric or sub-atmospheric conditions, and may further include corrosive conditions such as etch or deposition environments. The feedthrough 10 supplies an electric current from a source external to the enclosure, through the body of the feedthrough 10, and into an electrical apparatus located within the enclosure.

Figure 2:
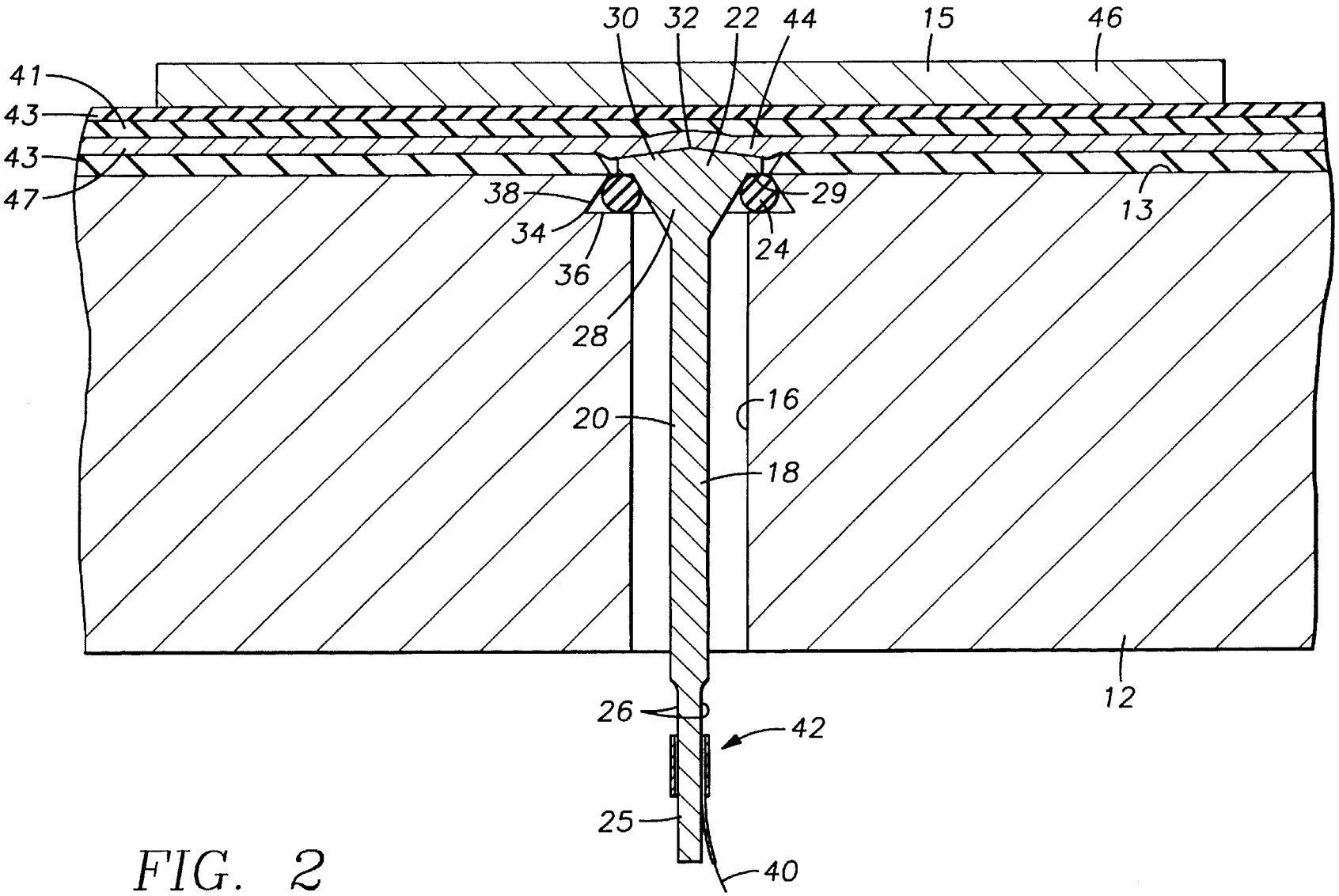
FIG. 2 is a sectional view of the feedthrough and the wall of the enclosure of FIG. 1 showing the detail of the interconnection of the feedthrough to an internal enclosure component.

Referring now to FIGS. 1 and 2, the feedthrough apparatus 10 of the present invention includes a body portion formed as a generally cylindrical, pin-shaped, electrical conductor hereinafter referred to as the pin 18. The pin 18 has a stem portion 20 received through the aperture 16 and an enlarged head portion 22 facing the interior of the enclosure adjacent to the interior surface 13 of the wall 12 and extending over the aperture 16. A seal 24 is disposed about the terminus of the aperture 16 at the interior surface 13 of the wall 12 and extends circumferentially about the junction of the head 22 and the stem 20. A biasing member 15 located within the interior of the enclosure biases the head 22 into engagement with the seal 24 to seal the aperture 16.

Figure 4:
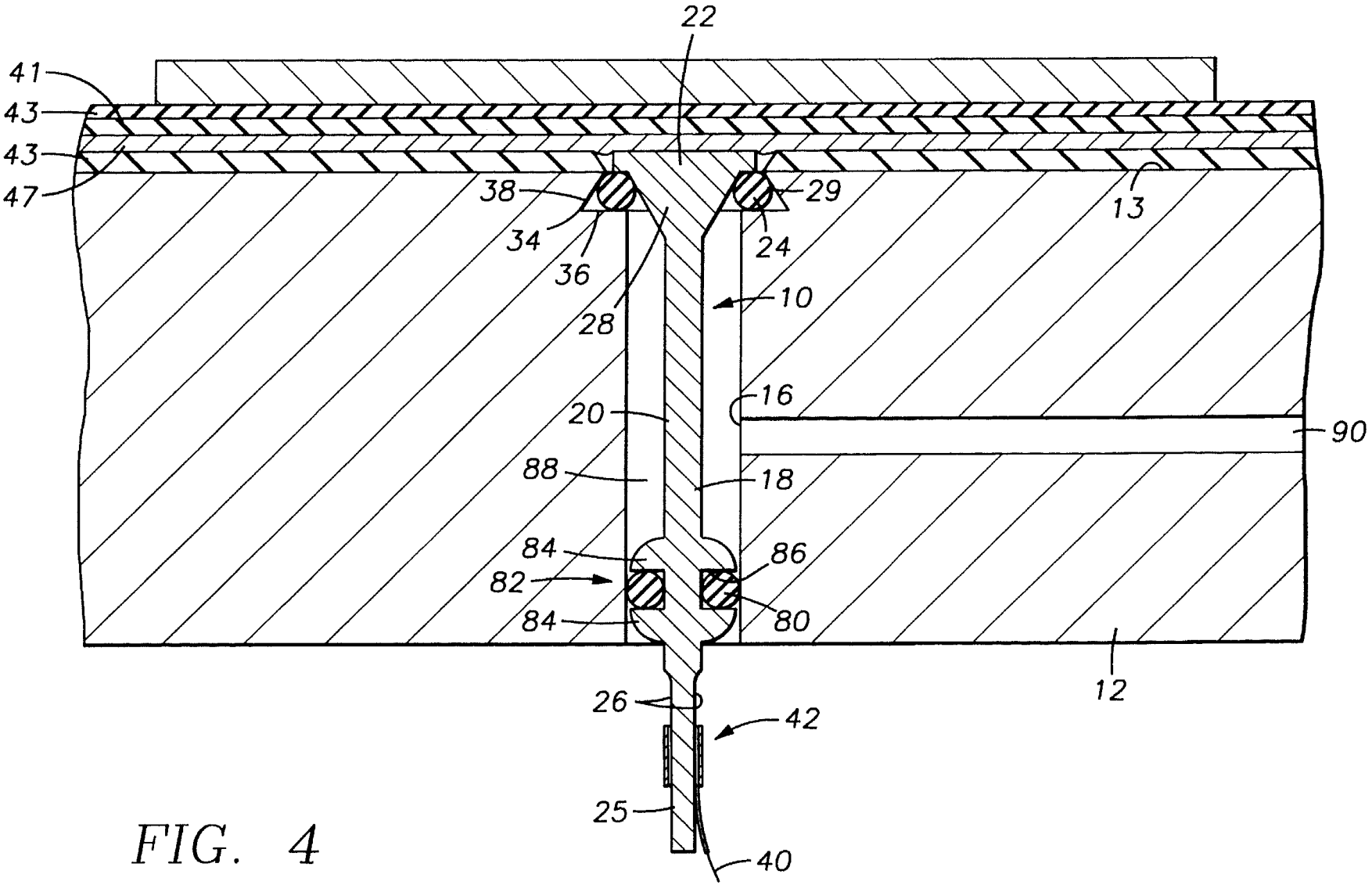
FIG. 4 is a sectional view of a portion of a wall of an enclosure showing an additional alternative embodiment of the feedthrough of the present invention extending through an aperture in the wall of the enclosure.

The pin 18 is preferably a one-piece stainless steel member, and the head 22 and the stem 20 are preferably formed thereon by turning. In certain applications, where the enclosure environment reacts with steel, the pin 18 is preferably made by turning aluminum stock to form the head 22 and stem 20. In applications where the surface finish and dimensional tolerance of the pin 18 are not critical, the pin 18 may be formed by stamping. The length of the stem 20 is preferably at least one and one-half times the thickness of the wall 12. To easily interconnect the pin 18 to an electrically conductive terminal, the portion of stem 20 extending outwardly from the enclosure interior is formed as a generally flat tongue 25. The tongue 25 is preferably formed on the stem portion 20 by grinding, milling or stamping opposed flats 26 on the lower portion of the stem 20. As best shown in FIG. 2, the head 22 has a larger diameter than the aperture 16 and includes a lower annular face 29 and a lower extending conical portion 28 which connects to the upper end of the stem 20, and an upper crowned portion 30 which preferably terminates in a point 32 forming the upper, central terminus of the head 22. Alternatively, the head 22 may include a generally flat upper surface as shown in FIG. 4, or may have a hemispherical or other profile.

The seal 24 is preferably an o-ring seal, made from a flouroelastomer such as Viton®, available from DuPont Corporation, having an outer diameter slightly larger than the outer circumference of the head 22, and an inner diameter approximately equal to the outer diameter of the stem 20. To align and retain the seal 24 in place about the aperture 16, an annular frustoconical recess 34 may be provided in the interior surface 13 of the enclosure wall 12 about the inner terminus of the aperture 16 as best shown in FIG. 2. The recess 34 preferably includes a first annular flat portion 36 extending outwardly from the aperture 16 below and generally parallel to the interior surface 13 of the enclosure wall 12, and an upwardly, inwardly sloping wall 38 extending from the outer terminus of the flat portion 36 to the interior surface 13 of the enclosure wall which forms the outer, upper, boundary of the recess 34. The upper, inner diametrical terminus of the sloping wall 38 has a slightly smaller diameter than the outer diameter of the seal 24. Thus, when the seal 24 is placed in the recess 34, it is retained in place by the sloping wall 38 which extends slightly over the upper, outer quadrant of the seal 24. This retention feature allows the seal 24 to be retained in the recess 34 about the aperture 16 irrespective of the physical orientation of the aperture 16 without the need to hold the seal 24 in place by hand as the pin 18 is assembled in place. Although a frustoconical recess 34 for receiving the seal 24 is shown and described, a square recess formed as a simple enlarged counterbore about the aperture 16, or no recess, may be substituted for the frustoconical recess 34 without deviating from the scope of the invention.

The seal 24, in conjunction with the conical portion 28 of the pin 18 and the recess 34, aligns the pin 18 within aperture 16 to prevent contact between the wall 12 and the pin 18. As the pin 18 is placed into the aperture 16, its conical portion 28 is received through the center of the seal 24. As described before, the seal 24 is substantially fixed against movement in the recess 34. Therefore, the receipt of the conical portion 28 in the seal 24 centers the stem 20 and the pin 18 within the seal 24. As the seal 24, when located in the recess 34, is also centered in the aperture 16, the pin 18 also becomes centered in the aperture 16. This prevents the stem 20 from contacting the wall of the aperture 16. Additionally, the seal 24 isolates the head 22 from contact with the interior surface 13 of the wall 12 because the minimum diameter of the inwardly sloping wall 38 of the recess 34 is larger than the outer diameter of head portion 22. This ensures electrical isolation of the pin 18 from the wall 12.

To provide the electrical source to an internal component such as a printed circuit board 46 located within the enclosure, an electrical power or signal lead 40 is connected to the tongue 25 of the stem portion 20 by means of a slip-on terminal 42. The pin 18 passes the current supplied from the lead 40 and slip-on terminal 42 through the stem 20, the head 22 and the point 32 to a contact 44 on the printed circuit board 46. The printed circuit board 46 preferably includes a central flexible core 41 and a circuit pattern 47 printed on its lower surface. Thin layers of polyimide 43 sandwich the core 41 and circuit pattern 47. The printed circuit board 46 may be a separate enclosure component, such as a resistance heater, or it may serve as a current path to other componentry within the enclosure. The contact 44 is preferably an enlarged thickness area on the circuit pattern 47 of the printed circuit board 46, and is preferably formed by tinning the circuit pattern 47 to form a solder dot which is aligned through an aperture in the lower polyimide layer 43 which registers over the aperture 16 in the wall 12 to receive the point 32 of the head 22 thereagainst. Additionally, other contact means, such as solder or conductive adhesive, may be used to connect the head 22 to internal componentry if the internal connection is compatible with such use. For example, the head 22 could be soldered to a wire lead within the enclosure, or a conductive adhesive could be used to attach the head 22 to the contact 44 of the printed circuit board 46. The slip-on terminal 42 preferably includes terminal, having a crimp portion crimped onto the end of the lead 40 and a spring-loaded conductor portion which is receivable over the tongue 25. The spring loaded conductor portion engages the tongue 25 to maintain the terminal 42 on the pin 18. One such terminal is available from Thomas & Betts Corp. of Memphis, Tenn. and is sold under the name "Quick Disconnect." Other connectors and connection means, such as solder or conductive adhesives, may be substituted for terminal 42.

To seal the enclosure interior at the aperture 16, the biasing member 15 includes a cover plate 48, preferably a stainless steel member, which extends over the portion of the printed circuit board 46 extending over the aperture 16 and in engagement with the head 22 of the pin 18. As shown in FIG. 1 a plurality of screws 50, preferably three (only two shown), pass through an area where no circuitry is present and are screwed into mating threaded holes in the wall 12. The screws are tightened into the holes to bias the plate 48 and the primed circuit board 46 downwardly, and thus bias the annular face 29 on the underside of the head 22 of the pin 18 against the seal 24 as shown in FIG. 2. This creates continuous contact between the seal 24, the head 22 and the annular frustoconical recess 34, which ensures a seal around the aperture 16. Further, the point 32 of the pin 18 is simultaneously biased into the contact 44 in the printed circuit board 46 to ensure electric contact between the pin 18 and the printed circuit board 46. Additionally, as the pin 18 is biased downwardly, its conical portion 28 centers the stem 20 in the seal 24 to prevent contact between the pin 18 and the wall 12 within the aperture 16. In certain corrosive enclosure environments, the integrity of the seal material used in the seal 24 may be adversely affected. To preserve the integrity of the enclosure environment at the aperture 16 where the seal material is adversely affected by the enclosure environment, the seal 24 need only be periodically replaced as a maintenance item, which is a simple mechanical task given the structure of the feedthrough 10, to ensure the integrity of the seal at the aperture 16.

Figure 3:
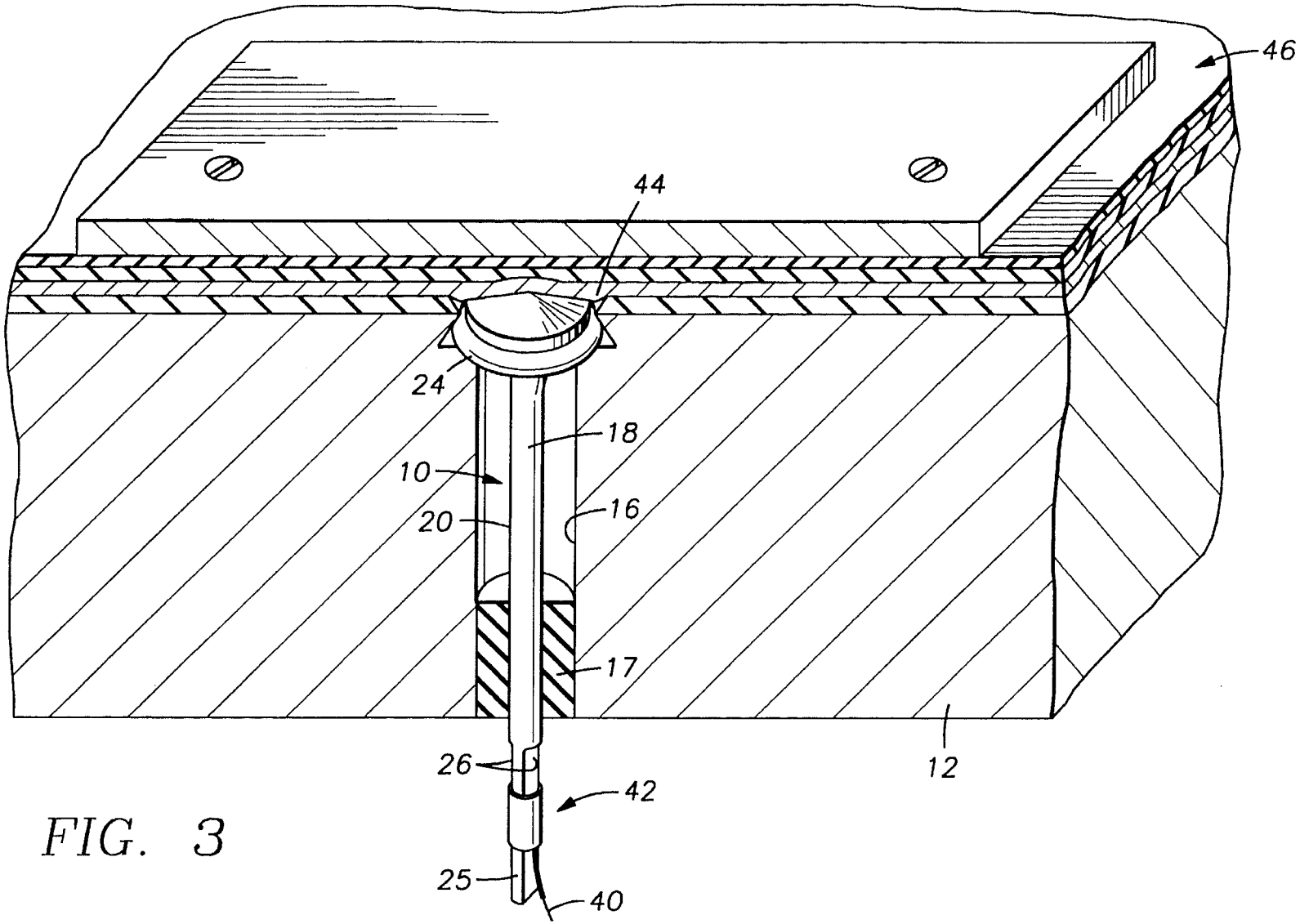
FIG. 3 is a perspective view, in section, of a portion of a wall of an enclosure showing an alternative embodiment of the feedthrough of the present invention extending through the wall of the enclosure.

Referring now to FIG. 3, an alternative embodiment of the connection of the feedthrough 10 through the enclosure wall 12 is shown. In this embodiment, the feedthrough 10 includes the pin 18 configured to provide a current path from a lead 40 through an aperture 16 in the wall 12 of the enclosure to a contact 44 on a printed circuit board 46. The aperture 16 includes an electrically insulative annular member such as a sleeve 17 therein which centers the stem 20 of the pin 18 within the aperture 16 to prevent contact between the pin 18, which is maintained at a voltage potential, and the enclosure wall 12. The sleeve 17 may be an insulative material formed as an annular cylinder which receives the stem 20 therethrough, or may be an insulative o-ring which is pressed upwardly about the stem 20 and into the aperture 16. By using the sleeve 17, the conical portion 28 of the pin 18 may be eliminated, because the sleeve 17 fully aligns the pin 18 in the aperture 16.

The sleeve 17 may be configured to seal the exterior opening of the aperture 16 about the stem 20. By sealing the exterior opening of the aperture 16, and simultaneously sealing the enclosure end of the aperture 16 with the seal 24, the space within the aperture 16 between the sleeve 17 and the seal 24 may be maintained at conditions different than those present in both the enclosure interior and in the ambient area surrounding the enclosure. For example, if the enclosure is maintained at a hard vacuum, or the criticality of maintaining the seal at the enclosure end of the aperture 16 is high, the conditions within the aperture 16 may be maintained at a pressure between the enclosure pressure and exterior pressure. Further, if the interior of the enclosure is filled with corrosive or explosive gases, an inert gas may be maintained in the space between the seal 24 and the sleeve 17 to form a secondary barrier against leakage of the gas from the enclosure through the aperture 16.

Referring now to FIG. 4, an additional alternative embodiment of the feedthrough 10 of the present invention is shown. In this embodiment, a secondary seal 80 is provided about the pin 18 and positively positioned on the pin 18 adjacent the exterior end of the aperture 16. The secondary seal 80 is located on the stem portion 20 adjacent the exterior opening of the aperture 16 and, in conjunction with the seal 24 maintained between the head 22 of the pin 18 and the recess 36 adjacent the enclosure end of the aperture 16, forms the boundary of a buffer chamber 88. To secure the secondary seal 80 in position in the aperture 16, a seal gland 82 is preferably provided on the stem 20 and the secondary seal 80 is received therein. The gland 82 is preferably formed of two raised areas 84 on the stem 20 having a gap 86 therebetween. The height of the raised areas 84 is approximately one-half the thickness of the secondary seal 80. The raised areas 84 secure the secondary seal 80 in the gland 82 to maintain the secondary seal 80 in a relatively fixed position in the aperture 16. Thus, the secondary seal 80 will not substantially move as the buffer chamber 88 is conditioned. The buffer chamber 88 may be evacuated or pressurized, and/or may receive a buffer material such as Argon or Helium therein. To condition the buffer chamber 88, a supply port 90 extends into the aperture 16 between the seal 24 and the secondary seal 80. This port 90 may be selectively connected to vacuum, pressure or gas sources to selectively condition the buffer chamber 88. The buffer chamber 88 may also be formed by locating the secondary seal 88 in a gland in the aperture 16, or by otherwise retaining a seal within the aperture 16 in sealing contact with the aperture 16 and the stem 20.

Figure 5:
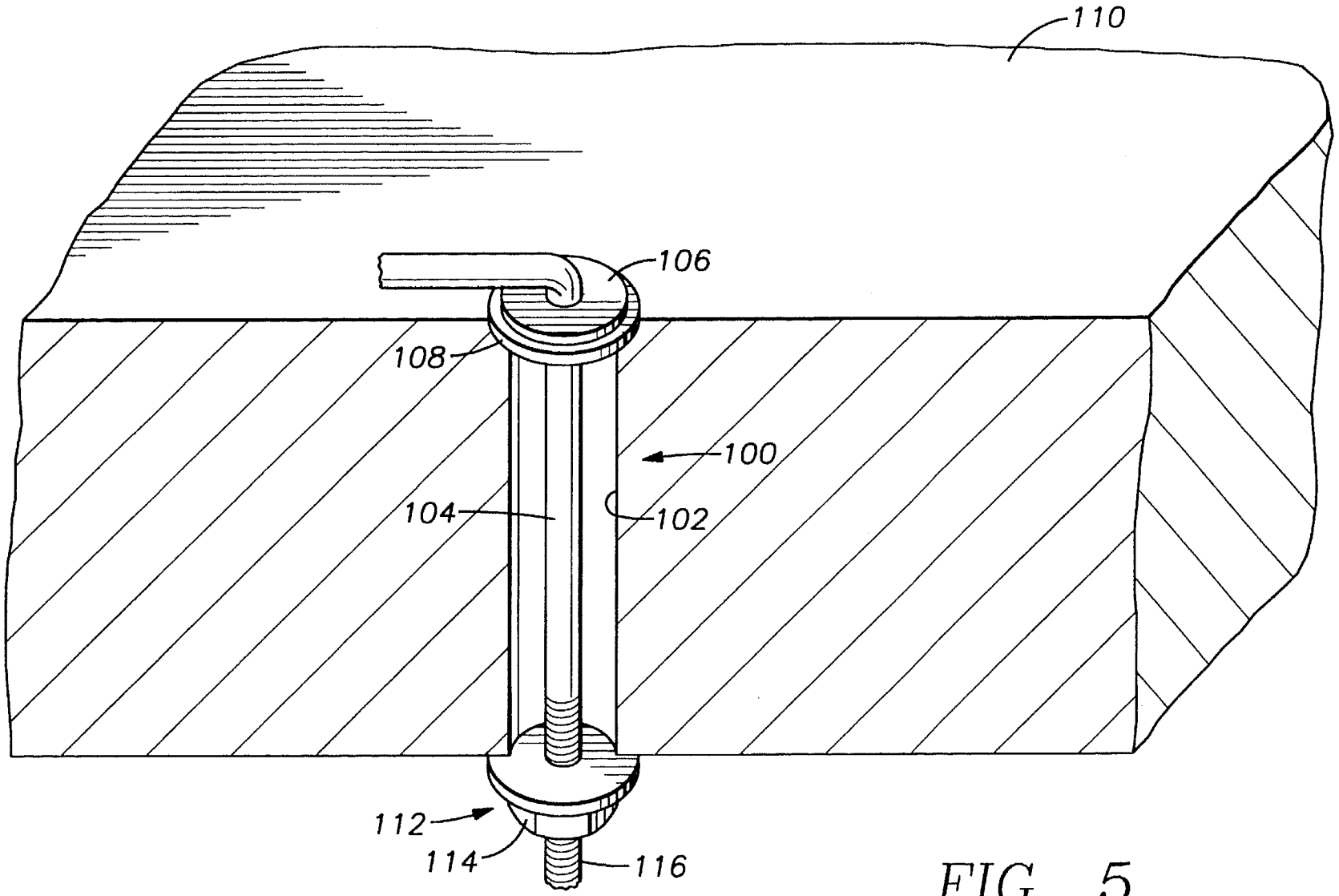
FIG. 5 is a perspective view, in section, of a portion of a wall of an enclosure showing a further alternative embodiment of the feedthrough of the present invention extending through an aperture in the wall of the enclosure.

Referring now to FIG. 5, a further alternative embodiment of the present invention is shown. In this embodiment, a feedthrough carrier 100 is provided to extend a feed apparatus through an aperture 102 in the enclosure wall 110. The feedthrough carrier 100 includes a generally tubular member 104 through which the feed apparatus is routed, an enlarged head portion 106 preferably formed as an integral part of the tubular member 104, an elastic seal member 108 disposed between the head portion 106 and the enclosure wall 110 around the aperture 102, and a biasing member 112 disposed adjacent the aperture 102 on the exterior of the enclosure wall 110. The head portion 106 abuts the seal member 108 and is biased thereagainst by biasing member 112 to seal the interior end of aperture 102. In the preferred embodiment, the biasing member 112 includes a flanged nut 114, which is received over threads 116 in the tubular portion 104 adjacent the exterior of the aperture 102. As the nut 114 is tightened on the threads 116 on the tubular portion 104, it engages against the exterior of the enclosure wall 110 and thus pulls the head portion 106 of the feedthrough carder 100 downwardly on the seal 108 to bias the seal 108 into sealing engagement with the underside of the head portion 106 and with the wall 110 around the interior end of the aperture 102. Other biasing members, such as spring loaded clips, a plate loaded over the head portion 106, or other mechanisms may be substituted for the ranged nut 114 and threads 106 to bias the seal 108 into sealing engagement. Further, the position of the ranged nut 114 and the head portion 106 and seal 108 may be reversed, and/or the space within the aperture 102 between the head portion 106 and the ranged nut 114 may be configured as a buffer chamber.

The configuration of feedthrough carrier 100 is useful for routing several different feed apparatuses into an enclosure. For example, a fiber optic cable having an outer insulative sheath enclosing a fiber optic guide may be routed into an enclosure using the configuration of feedthrough carrier 100. Where a fiber optic cable is used, the outer sheath of the cable may be used as the tubular member 104 of the feedthrough carrier 100, such that the fiber optic guide extends through the interior of the sheath. The fiber optic guide may carry visible light or electromagnetic radiation having other wavelengths through the feedthrough carrier 100. Alternatively, the feedthrough carrier 100 may be used to feed liquids or gases into the enclosure. In that instance, the tube in which the liquid or gas is carried is preferably used as the tubular member 104, and the nut 114 is threaded over the tube to secure the tube in place on the enclosure wall 110. Preferably, where the feedthrough carrier 100 is configured to route gases or liquids into the enclosure and the tube through which the gases or liquids pass is an electrical conductor, the nut 116 and the seal 108 are formed from an electrically insulative materials to electrically insulate the electrically conductive feed tube from the enclosure wall 110. Alternatively, the tubular body 104 may be formed from an insulative material that is molded or otherwise adhered over an electrically conductive gas or liquid feed tube, to insulate the electrically conductive feed tube from the enclosure wall 110. In this configuration, the inner conductive tube may feed consumable liquids or gases into the enclosure, or the inner conductive tube may be used to pass liquids and gases into the enclosure to heat or cool components located therein.

The present invention provides an easily installed field replaceable feedthrough which may be used in multiple enclosure or chamber environments. The feedthrough is suited to atmospheric, sub-atmospheric and super-atmospheric enclosure or chamber applications, with or without corrosive environments, where signal, power, or other conduits must be routed through the chamber or enclosure walls. The feedthrough is easy to install with no specialized equipment. Therefore, it may be retrofitted in enclosure or chamber walls where glass, ceramic or epoxy based feedthroughs are present. Additionally, the individual configurations of the biasing members and feedthrough bodies may be interchanged to form multiple feedthrough configurations without deviating from the scope of the invention.

I claim:

1. A feedthrough for providing a sealed connection through an aperture extending through a wall of an enclosure to pass a signal between a first component maintained on a first side of the enclosure wall and a second component maintained on a second side of the enclosure wall, comprising:

a body having a stem portion extending through the aperture and projecting therefrom and a head portion received over one opening of the aperture in the wall of the enclosure;

a seal member disposed about the aperture intermediate said head portion and the wall of the enclosure, said seal providing spacing of said stem from the aperture to prevent contact between said stem and the enclosure wall;

a contact contactable with said head portion to provide physical contact between said contact and said head portion; and a bias member biasing said seal member into sealing engagement against said head portion and against the wall of the enclosure, and further biasing said contact into engagement with said head portion.

2. The feedthrough of claim 1, wherein said body is electrically conductive.

3. The feedthrough of claim 1, wherein said bias member is a plate disposed over said head portion and connected to the wall of the enclosure.

4. The feedthrough of claim 1, wherein at least one side of the enclosure wall is in communication with a chamber, and wherein the contact is disposed within the chamber and engageable with said head portion.

5. The feedthrough of claim 4, wherein said head portion includes a raised portion thereon contacting said contact.

6. The feedthrough of claim 5, wherein said contact is formed on a printed circuit board.

7. The feedthrough of claim 1, wherein the wall of the enclosure adjacent the aperture includes an annular recess and said seal member is retained in said recess.

8. The feedthrough of claim 7, wherein said recess has a frustoconical profile.

9. The feedthrough of claim 1, wherein said head portion includes an enlarged conical alignment portion received in said seal member to align said body in the aperture.

10. The feedthrough of claim 1, wherein the aperture includes an insulative annular member therein and said stem portion extends through said insulative annular member.

11. The feedthrough of claim 1, wherein said body receives a feed apparatus therethrough.

12. The feedthrough of claim 11, wherein said feed apparatus is a fiber optic guide.

13. The feedthrough of claim 11, wherein said feed apparatus is a tubular feed member.

14. The feedthrough of claim 1, wherein said head portion is electrically insulative.

15. The feedthrough of claim 1, wherein said bias member is received on said stem portion.

16. The feedthrough of claim 15, wherein said stem portion includes threads thereon, and said bias member includes a nut received on said threads and biased into engagement with the wall of the enclosure.

17. The feedthrough of claim 1, wherein said stem portion includes a gland thereon, and a secondary seal is received in said gland and seals against said stem portion and the aperture to form a buffer chamber within the aperture between said seal member and said secondary seal.

18. The feedthrough of claim 17, further including an access port extending into said buffer chamber.

19. The feedthrough of claim 17, wherein said buffer chamber is maintained at conditions different than the conditions within the enclosure.

20. The feedthrough of claim 1, wherein said body portion further includes a tapered portion extending from said head portion to said stem portion.

21. The feedthrough of claim 1, wherein said head portion includes a conical surface opposed to said stem portion; and a connector received over, and biased into, physical connective contact with said conical portion.

22. The feedthrough of claim 21, wherein said seal extends from said head portion and terminates outwardly of said aperture.

23. The feedthrough of claim 22, wherein said conical portion, when received in said seal, centers said stem in said aperture.

24. A method of providing a sealed electrical connection through an aperture in a wall of an enclosure, comprising:

locating a seal at the terminus of the aperture through the wall;

providing an electrically conductive body member having a stem portion and an enlarged head portion;

extending the stem portion through the aperture;

locating the head portion against the seal;

providing an electrical contact within the enclosure;

biasing the electrical contact into contact with the head portion; and biasing the head portion against the seal to provide sealing engagement between the head portion and the seal and between the seal and the enclosure wall, while simultaneously physically isolating the body portion from the enclosure surface.

25. The method of claim 24, further including the step of locating a biasing member within the enclosure to bias the head portion against the seal.

26. The method of claim 24, further including the steps of:

providing an annular recess about the periphery of the aperture at the terminus of the aperture in the enclosure; and, locating the seal at least partially in the recess.

27. The method of claim 24, wherein the contact is provided on a printed circuit board.

28. The method of claim 24, further including the steps of:

providing a buffer chamber in the aperture; and conditioning the buffer chamber.

29. The method of claim 26, wherein the step of providing a buffer chamber in the aperture includes the step of providing a secondary seal in contact with the stem portion and a wall of the aperture.

30. A feedthrough for providing a sealed connection through an aperture extending through a wall of an enclosure, comprising:

a body having a stem portion extending through the aperture and a head portion received over one opening of the aperture in the wall of the enclosure;

a seal member disposed about the aperture intermediate said head portion and the wall of the enclosure;

a bias member biasing said seal member into sealing engagement against said head portion and against the wall of the enclosure;

wherein said stem portion includes a gland thereon, and a secondary seal is received in said gland and seals against said stem portion and the aperture to form a buffer chamber within the aperture between said seal member and said secondary seal; and an access port extending into said buffer chamber.

31. A feedthrough for providing a sealed connection through an aperture extending through a wall of an enclosure, comprising:

a body having a stem portion extending through the aperture and a head portion received over one opening of the aperture in the wall of the enclosure;

a seal member disposed about the aperture intermediate said head portion and the wall of the enclosure;

a bias member biasing said seal member into sealing engagement against said head portion and against the wall of the enclosure;

wherein said stem portion includes a gland thereon, and a secondary seal is received in said gland and seals against said stem portion and the aperture to form a buffer chamber within the aperture between said seal member and said secondary seal and said buffer chamber is maintained at conditions other than those maintained in the enclosure.

32. A method of providing a sealed connection through an aperture in a wall of an enclosure, comprising:

locating a seal at the terminus of the aperture through the wall;

providing a body member having a stem portion and an enlarged head portion;

extending the stem portion through the aperture;

locating the head portion against the seal;

biasing the head portion against the seal;

providing a buffer chamber in the aperture; and conditioning the buffer chamber.

33. A method of providing a sealed connection through an aperture in a wall of an enclosure, comprising:

locating a seal at the terminus of the aperture through the wall;

providing a body member having a stem portion and an enlarged head portion;

extending the stem portion through the aperture;

locating the head portion against the seal;

biasing the head portion against the seal;

forming a buffer chamber in the aperture by extending a second seal between the stem portion and the aperture wall; and conditioning the buffer chamber.

* * * * *